United States Patent [19]

Goodfellow et al.

[11] Patent Number: 4,460,119

[45] Date of Patent: Jul. 17, 1984

[54] DOOR HANGING ENVELOPE

[76] Inventors: Anthony E. B. Goodfellow, 3 Clarendon Dr., Wymbush, Milton Keynes MK8 8DA, England; James C. Kennemer, P.O. Box 2165, Birmingham, Ala. 35201; Timothy J. Donlevy, Chapman House, Farwig La., Bromley Kent, BR1 3QS, England

[21] Appl. No.: 406,162

[22] Filed: Aug. 9, 1982

[30] Foreign Application Priority Data

May 5, 1982 [GB] United Kingdom ..... 8212948

[51] Int. Cl.[3] ..... B65D 27/08

[52] U.S. Cl. ..... 229/68 R; 229/71; 229/72; 229/74; 206/806; 40/331; 40/2 R

[58] Field of Search ..... 229/68, 74, 71, 73, 229/72; 206/806, 554; 40/2 R, 331, 332, 325, 21 R

[56] References Cited

U.S. PATENT DOCUMENTS

| | | | |
|---|---|---|---|
| 478,185 | 7/1892 | Barnum | 40/21 R |
| 1,371,813 | 3/1921 | Robinson | 229/74 |
| 1,382,426 | 6/1921 | Kleebauer | 229/74 |
| 1,529,381 | 3/1925 | Townsend | 229/74 |
| 1,853,622 | 4/1932 | Kennedy | 206/806 |
| 1,969,428 | 8/1934 | Schwartz | 206/806 |
| 2,001,489 | 5/1935 | Elbaum | 229/72 |
| 2,580,886 | 1/1952 | Broudy | 229/72 |
| 4,201,299 | 5/1980 | Bumgarner et al. | 206/554 |

*Primary Examiner*—Stephen P. Garbe
*Assistant Examiner*—Bryon Gehman
*Attorney, Agent, or Firm*—Fleit, Jacobson, Cohn & Price

[57] ABSTRACT

An envelope which, for the purposes of delivery, may be hung over a door knob. The envelope comprises an envelope portion provided with a flap for closing that envelope portion, and a hanging portion from which the envelope portion is separable, the hanging portion being formed with an aperture from which a slit radiates and provided with a flap for sealing across the slit once the envelope has been applied (by its aperture) to the door handle.

5 Claims, 1 Drawing Figure

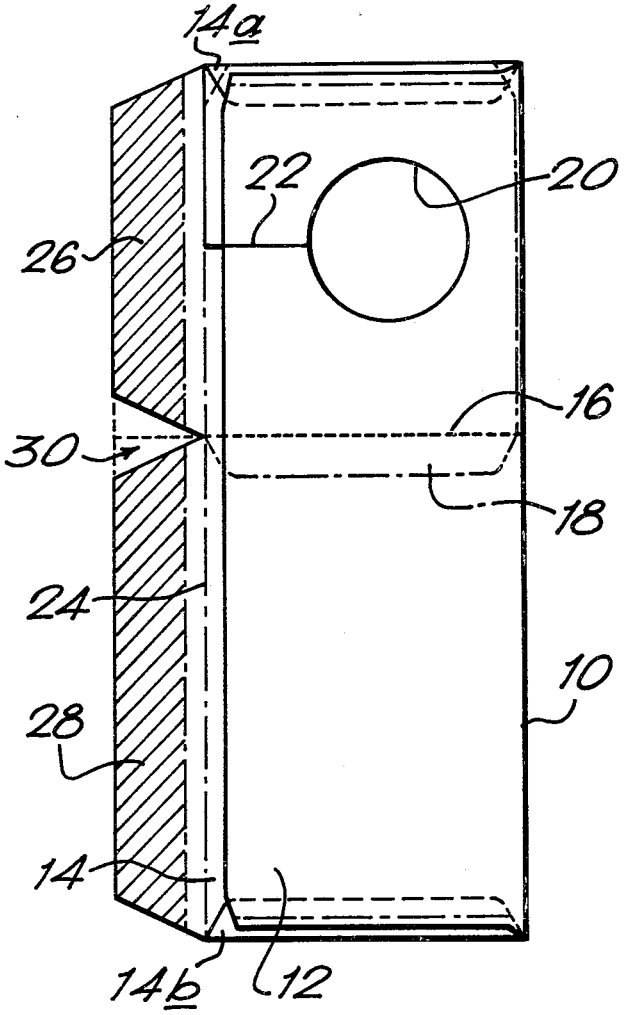
14a
22
20
26
16
30
18
24
10
28
14
14b
12

DOOR HANGING ENVELOPE

This invention relates to an envelope which, for the purposes of delivery, may be hung over a door knob.

This invention has particular but not sole use for a utility meter reader who, after reading a customer's meter, produces a bill which he places in the envelope (for example to add to other contents already within the envelope) and then hangs over the door knob.

In accordance with this invention, there is provided a door hanging envelope comprising first and second panels interconnected to form an envelope portion and provided with a flap for closing that envelope portion, and a hanging portion from which the envelope portion is separable, said hanging portion being formed with an aperture from which a slit radiates and provided with a flap for sealing across said slit. In use, the aperture is used for hanging the envelope on a door knob, with the slit permitting sufficient opening of the aperture for the enlarged end of the knob to pass through, and then sealing of the flap prevents removal of the envelope from the door knob without tearing the envelope.

An embodiment of this invention will now be described, by way of example only, with reference to the accompanying drawing, the single FIGURE of which is a plan view of a door hanging envelope in accordance with the invention.

The illustrated envelope comprises a blank of sheet material folded along a line 10 for one panel 12 to overlie a second panel 14, the panel 12 being glued to folded-over end flaps 14*a*, 14*b* of the panel 14. The envelope is divided into two portions, an envelope portion and a hanging portion, by a transverse line of perforations 16 formed through the superposed panels 12, 14. In the hanging portion, the two panels are glued together over their superposed areas and this area of glue extends into the envelope portion as a transverse strip 18. The hanging portion is formed centrally with a punched circular hole 20, and a punched slit 22 extending radially of the hole 20 to the line of fold 24 of two flaps 26, 28 which project along one longitudinal edge of the panel 14: these flaps are provided with glue over the areas shown.

In use, material such as a bill is placed in the envelope portion, then the envelope is hung on a door knob by means of the punched hole 20 and its associated slit 22. Then the flap 26 is folded over and sealed onto the panel 12, with effect of sealing the slit 22 over substantially the whole of its length, to prevent removal of the envelope from the door knob without tearing the envelope.

Preferably the glue used on flap 26 is of the self-adhesive type.

The envelope can be used as a return envelope and for this purpose may be provided with suitable preprinting of the address etc. The customer may separate the envelope portion from the hanging portion by tearing along the line of perforations, insert his material (e.g. payment cheque) into the envelope and seal it by means of the flap 28.

In a modification as shown in outline at 30, the two flaps 26,28 may be formed as one, with the line of perforations extending across it, so that when the flap portion 26 is sealed onto the hanging portion, the flap portion 28 is held across the envelope (without being sealed thereto) so as to prevent loss of the envelope contents.

Preferably the sheet material of which the envelope is made comprises a water resistant material for protection against wet weather.

The illustrated envelope can be produced economically on high speed, reel fed machinery, and advance contents can be placed in the envelope by standard envelope stuffing machines.

What is claimed is:

1. A door hanging envelope which comprises an envelope portion, said envelope portion being formed from two interconnected panels, a first flap for closing said envelope portion, a hanging portion, said hanging portion being separable from said envelope portion, an aperture from which a slit radiates to allow insertion in said hanging portion of a doorknob or the like which is larger than said aperture, and a second flap for sealing said slit so that said door hanging envelope cannot be removed from said doorknob or the like without tearing said envelope.

2. A door hanging envelope according to claim 1, wherein said first and second flaps form respective flap portions of one continuous flap, so that when said slit is sealed by said second flap portion, said first flap portion is held across said envelope portion to prevent the contents from falling out.

3. A door hanging envelope according to claim 2 wherein said second flap portion for sealing said slit is coated with self-adhesive type glue.

4. A door hanging envelope according to claim 2, wherein said first flap portion is coated with glue which is not self-adhesive

5. A door hanging envelope according to claim 1, wherein said envelope is formed from a single sheet of water resistant material.

* * * * *